US008286800B2

(12) United States Patent
Kojima et al.

(10) Patent No.: US 8,286,800 B2
(45) Date of Patent: Oct. 16, 2012

(54) SEPARATION METHOD AND SEPARATION APPARATUS

(75) Inventors: Tamao Kojima, Osaka (JP); Masatoshi Miyasaka, Osaka (JP); Hiroyuki Naka, Osaka (JP)

(73) Assignee: Panasonic Corporation, Osaka (JP)

( * ) Notice: Subject to any disclaimer, the term of this patent is extended or adjusted under 35 U.S.C. 154(b) by 190 days.

(21) Appl. No.: 12/867,960

(22) PCT Filed: Jan. 18, 2010

(86) PCT No.: PCT/JP2010/000227

§ 371 (c)(1),
(2), (4) Date: Aug. 17, 2010

(87) PCT Pub. No.: WO2010/100817

PCT Pub. Date: Sep. 10, 2010

(65) Prior Publication Data

US 2011/0056874 A1 Mar. 10, 2011

(30) Foreign Application Priority Data

Mar. 4, 2009 (JP) ..... 2009-051351

(51) Int. Cl.
*B07C 5/38* (2006.01)

(52) U.S. Cl. ..... 209/631; 209/552; 209/577; 209/580

(58) Field of Classification Search ..... 209/21, 209/22, 23, 132, 147, 581, 589, 631, 644, 209/938, 939

See application file for complete search history.

(56) References Cited

U.S. PATENT DOCUMENTS

| | | | | |
|---|---|---|---|---|
| 5,676,256 | A * | 10/1997 | Kumar et al. | 209/580 |
| 6,353,197 | B1 * | 3/2002 | Ulrichsen et al. | 209/577 |
| 6,506,991 | B1 * | 1/2003 | Eixelberger et al. | 209/581 |
| 6,888,917 | B2 * | 5/2005 | Sommer et al. | 378/58 |
| 7,658,291 | B2 * | 2/2010 | Valerio | 209/559 |
| 7,942,273 | B2 * | 5/2011 | Campbell et al. | 209/631 |
| 2009/0114571 | A1 * | 5/2009 | Miller et al. | 209/44.3 |

FOREIGN PATENT DOCUMENTS

| | | |
|---|---|---|
| DE | 101 23 304 | 12/2002 |
| EP | 1 048 363 | 11/2000 |
| JP | 2000-157936 | 6/2000 |
| JP | 2000-338036 | 12/2000 |
| JP | 2002-263587 | 9/2002 |
| JP | 2003-166879 | 6/2003 |
| JP | 2003-275692 | 9/2003 |

OTHER PUBLICATIONS

Extended European Search Report mailed Mar. 25, 2011 in corresponding European Search Patent Application No. 10742070.

* cited by examiner

*Primary Examiner* — Terrell Matthews
(74) *Attorney, Agent, or Firm* — Wenderoth, Lind & Ponack, LLP

(57) ABSTRACT

A separation method of separating first targets (2) and second targets (7) from a separation subject (101). The separation method includes: conveying the separation subject (101); distinguishing the first targets (2); obtaining positional information of the first targets (2); dropping the separation subject (101) from an end of a conveyance path; striking each of the dropping first targets with a pulsing first airflow (F1) so as to change a drop path of the first targets (2); and striking the first target, which is blown up to or above a predetermined height with a second airflow (F2) so as to change the drop path of the first target (2).

5 Claims, 4 Drawing Sheets

| Air blowing rate m/s | 0 | 1 | 2 | 3 | 5 | 10 | 20 | 30 | 50 | 80 | 100 |
|---|---|---|---|---|---|---|---|---|---|---|---|
| Recovery ratio % | 93.6 | 95.2 | 97.4 | 100 | 100 | 100 | 100 | 100 | 98.2 | 93.8 | 93.6 |

| Air discharge position mm | 40 | 60 | 80 | 100 | 200 | 300 | 400 | 500 | 600 | 700 | 800 | 900 |
|---|---|---|---|---|---|---|---|---|---|---|---|---|
| Recovery ratio % | 95.2 | 97 | 100 | 100 | 100 | 100 | 100 | 100 | 100 | 100 | 97.6 | 95.4 |

SEPARATION METHOD AND SEPARATION APPARATUS

BACKGROUND OF THE INVENTION

1. Technical Field

The present invention relates to a separation technique which is aimed at recycling used home appliances and separates resin pieces of a specific constituent substance and resin pieces of another constituent substance from a separation subject in which resin pieces of multiple types are mixed.

2. Description of the Related Art

In recent years, economic activity represented by mass production, mass consumption, and mass disposal have been aggravating environmental problems on a global scale, such as global warming and depletion of resources. Under such circumstance, also in our country, Home Appliance Recycling Law came into effect and obliges recycling of used air conditioners, televisions, refrigerators/freezers, and washing machines, with the aim of building a recycling society.

Conventionally, unneeded home appliances have been recycled by crushing and then separating them by material, using magnetism, wind, oscillation, etc., in home appliance-recycling plants. In particular, the recycling rate of metal materials is high because the use of a specific-gravity separation device or a magnetism separation device allows these materials to be separated by material such as iron, copper, aluminum, etc., and thus recovered in very pure form.

As to resin materials, polypropylene (hereinafter denoted as PP), which has a low specific gravity, is separated from a component having a high specific gravity through specific gravity segregation using water and thus recovered with a relatively high degree of purity. This specific gravity segregation using water, however, has significant problems in that an enormous amount of wastewater is produced and that polystyrene (hereinafter denoted as PS) and acrylonitrile-butadiene-styrene (hereinafter denoted as ABS), which have similar specific gravities, are not separated from each other. In addition, PP contains a filler, which is high in specific gravity and has seen increased demand in recent years, cannot be dealt with by the traditional specific gravity segregation.

A separation method in view of the above problems related to recycling of resin materials has been proposed in Japanese Unexamined Patent Application Publication No. 2002-263587.

The technique disclosed in JP 2002-263587 uses a substance distinguishing unit to detect a constituent substance, thereby enabling separation of resin materials which are inseparable by specific gravity.

To be specific, resin-mixed items conveyed on a conveyor belt are distinguished with the substance distinguishing unit, and in order to separate the distinguished items made of specific resin substance in a drop path of the resin-mixed items shot out of a conveying end of the conveyor belt, pulse air is shot out of a pulse air nozzle so that the items of specific resin substance are blown across a free-fall position of the resin-mixed items and thus separated from them.

This separation method enables separation of PS and ABS, which have similar specific gravity, and is applicable also to separation of PP containing filler, which has high specific gravity.

SUMMARY OF THE INVENTION

1. Technical Problem

However, in the technique disclosed in JP 2002-263587, the pulse air which is intended to blow the resin pieces of the specific constituent substance across the drop position for the resin-mixed items may strike the resin pieces of the specific constituent substance not on the center of gravity but on a point lower than the center of gravity. In such a case, the resin pieces will be blown high but a short distance, causing a failure to separate the resin pieces of the specific constituent substance, which results in a problem of a decreased recovery amount of the resin pieces of the specific constituent substance.

The present invention is intended to solve the above conventional problems and an object of the present invention is to provide a separation method and a separation apparatus which enable an increase in a recovery amount of resin pieces of a specific constituent substance.

2. Solution to the Problem

In order to solve the above problems, the separation method according to an aspect of the present invention is a separation method of separating first targets and second targets from a separation subject in which the first targets and the second targets are mixed. The separation method includes: conveying the separation subject; distinguishing the first targets in the separation subject; obtaining positional information of the first targets distinguished in the distinguishing; dropping the separation subject from an end of a conveyance path; striking a first airflow on each of the first targets that is dropping, so as to change a drop path of the first target, the first airflow being generated in a pulse mode; and blowing a second airflow on the first target which is blown up to or above a predetermined height in the striking, so as to change the drop path of the first target, the second airflow being generated at the predetermined height and in the same orientation as the first airflow shot out in the striking of a first airflow.

This makes it possible to change the drop paths along the way even when the first targets are blown high and a short distance. There can therefore be a high probability of separation of the first targets from the separation subject, thus allowing an increased recovery amount of the first targets.

Furthermore, it is preferable that the second airflow in the blowing have a blowing rate of 3 m/sec to 30 m/sec.

This makes it possible to enhance the separation probability of the first targets from the separation subject, allowing an enhanced recovery ratio of the first targets.

Furthermore, it is preferable that the predetermined height in the blowing operation be 80 mm to 700 mm above a height at which the first airflow strikes the first targets.

This makes it possible to effectively change only the drop paths of the first targets which are blown too high to be separated from the separation subject, without affecting the drop paths of the first targets which can be separated only through the striking.

In order to solve the above problems, the separation apparatus according to an aspect of the present invention is a separation apparatus that separates first targets and second targets from a separation subject in which the first targets and the second targets are mixed. The separation apparatus includes: a conveyor which conveys the separation subject placed thereon and drops the separation subject at a predetermined position; a distinguishing unit configured to distinguish the first targets in the separation subject; a positional information obtaining unit configured to obtain positional information of the first targets distinguished by the distinguishing unit; a first blower that generates, based on the positional information, a first airflow in a pulse mode which strikes each of the first targets that is dropping, so as to change a drop path of the first target; and a second blower that generates a second airflow which strikes the first target which is blown up to or above a predetermined height by the first airflow generated by the first blower.

This makes it possible to change the drop paths along the way even when the first targets are blown high and a short distance. There can therefore be a high probability of separation of the first targets from the separation subject, thus allowing an increased recovery amount of the first targets.

3. Advantageous Effects of the Invention

The falling first targets of the separation subject are bounced by the first airflow, and the drop path of the first target, which is bounced too high, is changed by the second airflow that is generated above a conveyor (such as a conveyor belt) and in the same orientation as the first airflow, thereby allowing an increased recovery amount of the first targets as compared to the conventional techniques.

BRIEF DESCRIPTION OF THE DRAWINGS

FIG. 1(*a*) is a front view thereof and FIG. 1(*b*) is a top view thereof. FIG. 1(*c*) is a side view showing the relationship between the first blower and the second blower.

DETAILED DESCRIPTION OF THE INVENTION

An embodiment of the present invention is described below with reference to the drawings.

Figure 1:
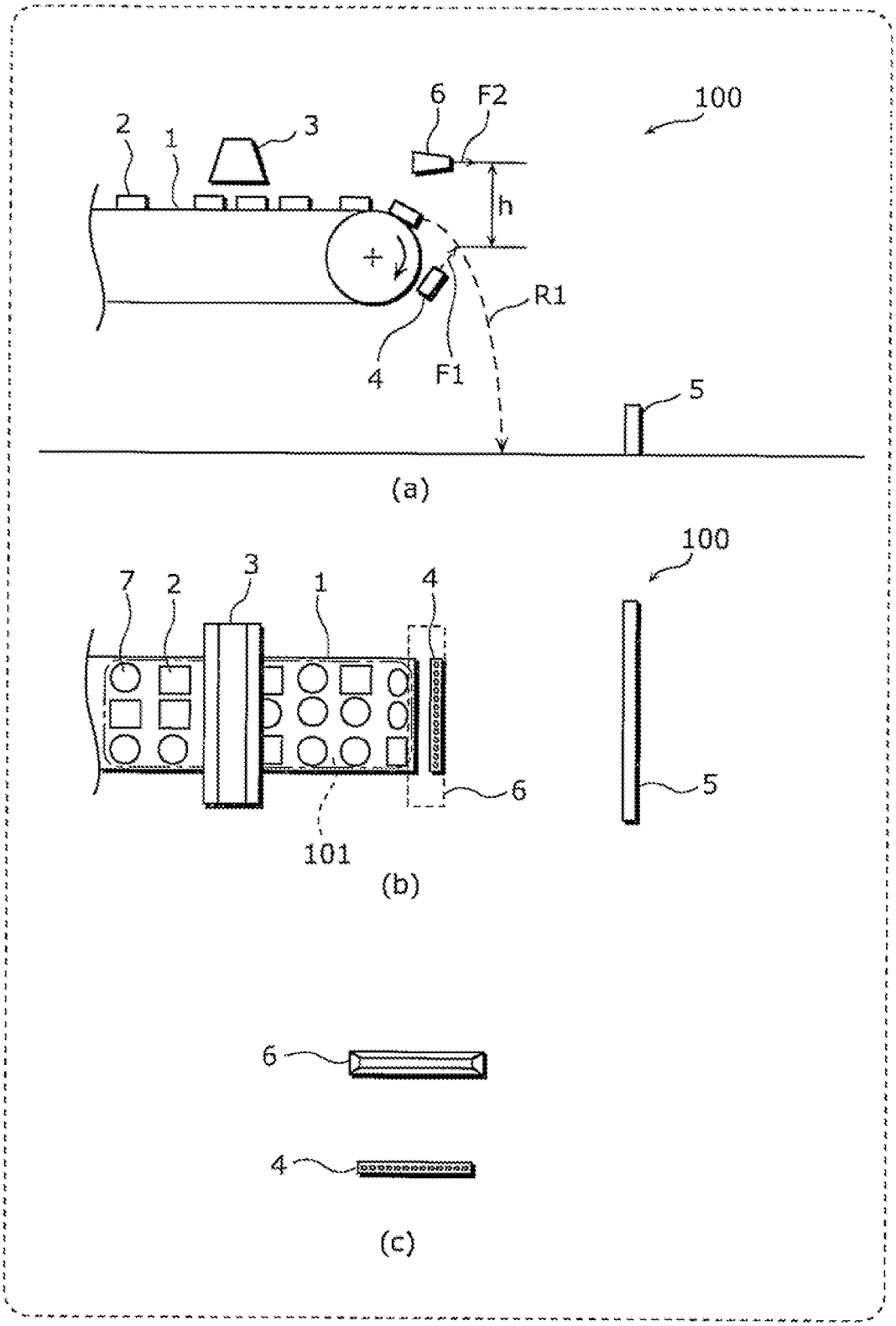
FIGS. 1(*a*)-1(*c*) are schematic views showing a separation apparatus according to an embodiment of the present invention.

FIG. 1 is a schematic view showing a separation apparatus according to an embodiment of the present invention; FIG. 1(*a*) is a front view thereof; FIG. 1(*b*) is a top view thereof; and FIG. 1(*c*) is a side view showing the relationship between the first blower and the second blower.

As shown in FIG. 1, a separation apparatus 100 is a separation apparatus for extracting a first target 2 from a separation subject 101 in which the first target 2 and a second target 7 are mixed, and includes a conveyor 1, an information obtainment unit 3, a first blower 4, and a second blower 6.

The conveyor 1 is a device on which the separation subject 101 is placed and thereby conveyed. In the case of the present embodiment, a belt conveyor is adopted as the conveyor 1.

The information obtainment unit 3 includes a distinguishing unit for distinguishing the first target 2 and the second target 7, and a positional information obtainment unit for obtaining positional information of the distinguished first target.

The distinguishing unit is a device for distinguishing the first target 2 and the second target 7. The distinguishing unit is, for example, a device which captures an image of the separation subject 101 and analyzes the resultant image to distinguish the first target 2 and the second target 7 by color, shape, design, and so on, or a device which includes a sensor having the highest sensitivity among sensors of various types such as near infrared sensors, middle infrared sensors, x-ray sensors, and image recognition sensors, and distinguishes the first target 2 and the second target 7 based on a difference in constituent substance between the first target 2 and the second target 7. In the case of the present embodiment, a near infrared distinguishing unit is used as the distinguishing unit, which is disposed above the conveyor 1.

In the case of the separation apparatus 100 according to the present embodiment, the separation subject 101 is transported in a direction indicated by an arrow on the belt conveyor serving as the conveyor 1, and the distinguishing unit is capable of obtaining positional information indicating where the constituent substance of the second target 2 is present and positional information indicating where other constituent substances are present, with a sensor scanning in a direction which intersects the transport direction of the belt conveyor. Thus, in the case of the present embodiment, the information obtainment unit 3 functions as not only the distinguishing unit but also as the positional information obtaining unit.

On the basis of the positional information of the first target 2 from the information obtainment unit 3, the first blower 4 generates a first airflow F1 in a pulse mode that strikes the falling first target 2 to change a first drop path R1 of the first target 2. In the case of the present embodiment, the first blower 4 includes a row of nozzles connected to a pneumatic source and is capable of selecting, based on the positional information, the nozzle from which the first airflow F1 is shot out in a pulse mode.

The second blower 6 is a unit which generates the second airflow F2 that blows the first target 2 up to or above a predetermined height by the first airflow F1 generated by the first blower 4. In the case of the present embodiment, the second blower 6 includes a nozzle with an elongated slit-like outlet connected to a pneumatic source, and constantly discharges the second airflow F2 at a blowing rate of 3 m/sec to 30 m/sec.

The position of the second blower 6 is set above a surface of the conveyor 1 on which the separation subject 101 is placed, and is located 80 mm to 700 mm above the height (denoted by "h" in FIG. 1) at which the first target 2 and the first airflow F1 strike each other.

It is to be noted that the present invention is not limited to the above embodiment. For example, the distinguishing unit may be one which is provided with multiple sensors arranged in an array or a matrix pattern and distinguishes the first targets 2 in multiple positions at a time.

The first blower 4 may have a single nozzle and move the nozzle based on the positional information. The second blower 6 does not need to continuously discharge the second airflow F2 and therefore may discharge it intermittently or with desired tinning.

While the first targets 2 are represented in squares and the second targets 7 are represented in circles in FIG. 1(*b*), these are given for the sake of convenience to differentiate these targets, which means that the shapes of the first targets 2 and the second targets 7 are not limited.

The separation plate 5 is a wall-like member for making a clear distinction between the separated first targets 2 and second targets 7.

Next, the separation method is described.

Figure 2:
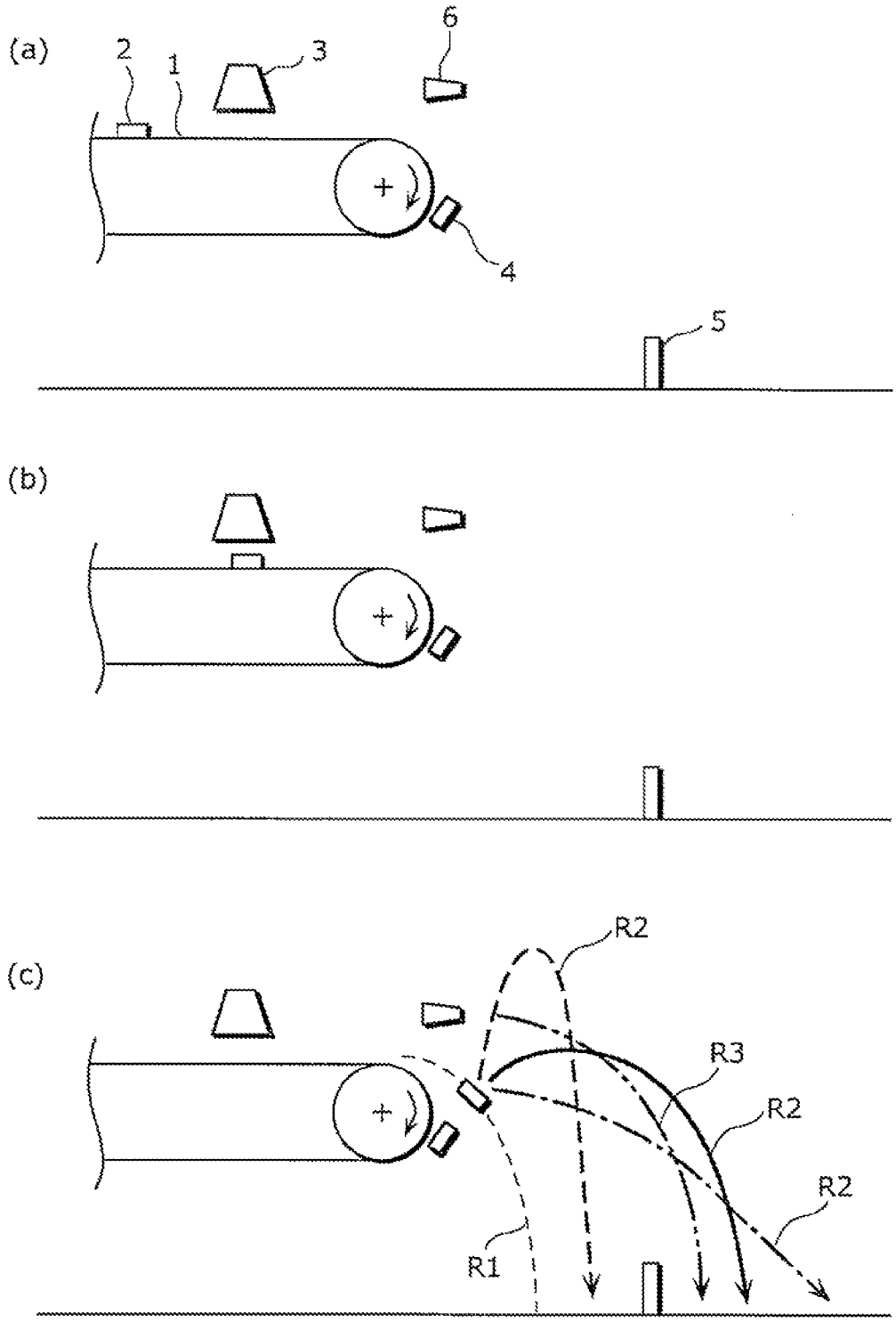
FIG. 2 is a process cross-sectional view showing a separation method according to an embodiment of the present invention.

FIGS. 2(*a*) to 2(*c*) show an embodiment of the separation method for the separation subject according to an implementation of the present invention and show the process of separating the desired first target 2 from the separation subject which is transported on the conveyor 1.

In FIG. 2(*a*), the first target 2 is being transported on the conveyor 1 (conveyor belt).

In FIG. 2(*b*), the first target 2 is passing under the information obtainment unit 3 so that the constituent substance and the shape are identified.

In FIG. 2(*c*), a solid line, a single-dotted-dashed line, and a broken line indicate representative examples of a trajectory of the first target 2 being blown up, which has been discharged from the conveying end of the conveyor 1 and blown by the first airflow F1 in a pulse mode from the first blower 4 placed below the first drop path R1 of the first target 2 and thereby changed its drop trajectory (the trajectories indicated by these solid line, single-dotted-dashed line, and broken line include the second drop path R2).

A shooting timing of the pulse airflow from the first blower 4 is controlled based on the information on constituent substance, shape, and position obtained from the information obtainment unit 3, and by striking the pulse airflow on the center of gravity of the first target 2, the first target 2 is made to travel on the trajectory indicated by the solid line so as to drop across the separation plate 5, thus being separated. Pieces other than the first targets 2 included in the separation subject are discharged from the conveying end of the conveyor 1 and then free-fall before the separation plate 5.

On the other hand, when the first airflow F1 generated in a pulse mode strikes the first target 2 not on the center of gravity but on a part (front edge part) lower than the center of gravity, the first target 2 travels on such a high trajectory as shown by the broken line and drops before the separation plate 5, thus failing to be separated. In the present invention, however, with the second blower 6 capable of supplying the second airflow F2 in the same orientation as the running direction of the conveyor 1 and in the same direction as the first airflow F1, the second drop path R2 of the first target 2 on a high trajectory is changed to the third drop path R3 (indicated by a double-dotted-dashed line in FIG. 2(*c*)) so that the first target 2 drops across the separation plate, resulting in an increased recovery amount of the first targets 2.

It is to be noted that in the case where the first airflow F1 generated in a pulse mode strikes the first target 2 in a part posterior to the center of gravity, the first target 2 travels on a low trajectory as indicated by the single-dotted-dashed line, but does not fall before the separation plate and is thus able to be separated.

EXAMPLE

The following shall describe in detail a method of separating the first targets 2 which are ABS resin pieces from the separation subject 101 according to an embodiment of the present invention.

Used refrigerators with compressors and thermal insulators from which chlorofluorocarbons had been removed were crushed by a crusher and collected as the separation subject 101. The separation subject 101 was then dispersed sequentially on the conveyor 1 (conveyor belt) running at 1 m/sec so that pieces in the separation subject 101 would not overlap one another. Next, a near infrared distinguishing unit was used as a distinguishing unit of the information obtainment unit 3 to distinguish the ABS resin pieces in the separation subject 101 being transported on the conveyor 1. The ABS resin pieces discharged from the conveying end of the conveyor 1 were then blown by the first airflow F1 (having a shooting pressure of 5 bar) in a pulse mode so as to fall across the separation plate 5, thus being separated.

In addition, the ABS resin pieces included in the separation subject 101 dropped before the separation plate 5 were distinguished using the near-infrared distinguishing unit to compare their weight with the weight of the ABS resin pieces dropped across the separation plate 5. Thus, a recovery ratio of the ABS included in the separation subject 101 was calculated.

The ABS recovery ratio was determined by A/(A+B)×100.

A: The weight of the ABS included in the separation subject 101 dropped before the separation plate.

B: The weight of the ABS dropped across the separation plate.

Figure 3:
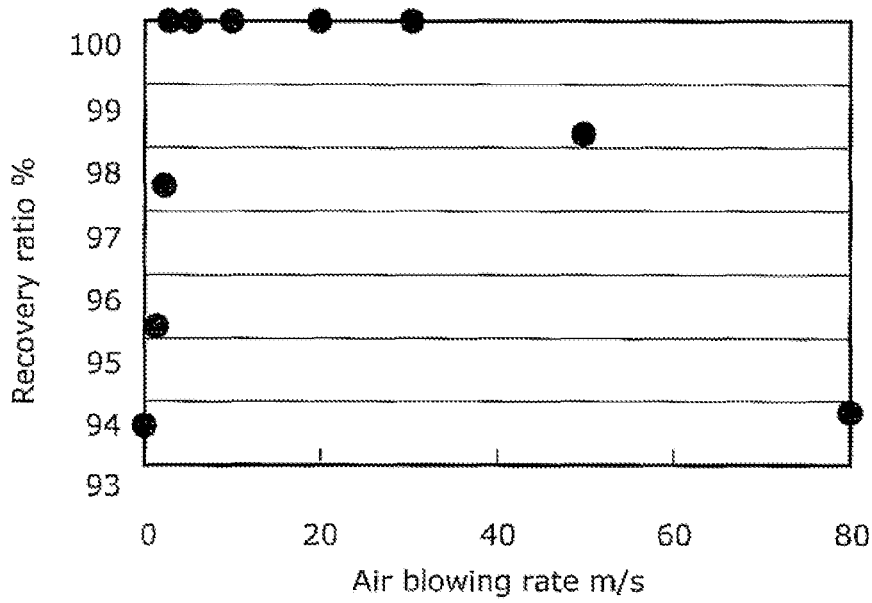
FIG. 3 is a graph and chart showing the relationship between a blowing rate of the second airflow F2 and a recovery ratio of ABS resin pieces in the embodiment.

FIG. 3 shows a relationship between the recovery ratio of the ABS resin pieces and the blowing rate of the second airflow F2 which the second blower 6 placed above the drop path of the separation subject 101 supplies in the same orientation as the running direction of the conveyor 1. The height h of the second airflow F2 discharged in the same orientation as the running direction of the conveyor 1 is set to be 200 mm above a position in which the first airflow F1 strikes the ABS resin pieces.

It was found that the recovery ratio of the ABS resin pieces improves along with an increase in the air blowing rate. When the rate of the second airflow F2 was set in the range of 3 m/sec to 30 m/sec, the recovery ratio was 100%. However, when the rate of the second airflow F2 was 50 m/sec or more, the recovery ratio of the ABS decreased, which revealed that when the air blowing rate is too high, this hinders the targets from being blown a substantial distance.

It is therefore preferable that the blowing rate of the second airflow F2 be 3 m/sec to 30 m/sec.

Figure 4:
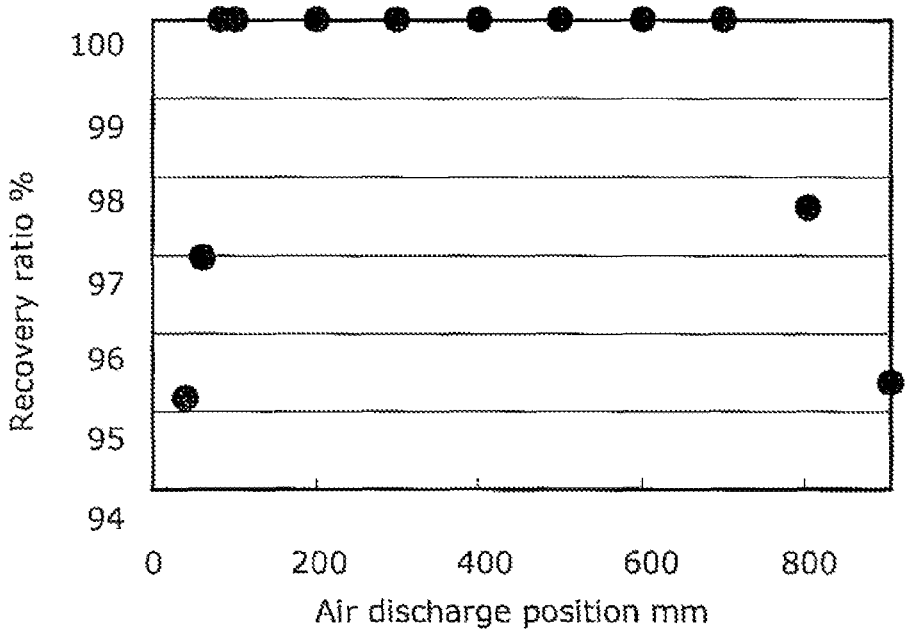
FIG. 4 is a graph and chart showing the relationship between a discharge position h of the second airflow F2 and a recovery ratio of ABS resin pieces in the embodiment.

FIG. 4 shows a relationship between the recovery ratio of the ABS resin pieces and the discharge position h of the second airflow F2 that is supplied in the same orientation as the running direction of the conveyor 1. The discharge position h of the second airflow F2 is a distance vertically above the intersection of the first airflow F1 with the first drop path R1 of the separation subject 101. The blowing rate of air that is supplied in the same orientation as the running direction of the conveyor 1 was set to be 10 m/sec.

It was found that the recovery ratio of the ABS resin pieces improves along with an increase in the height of the discharge position h. When the discharge position h is in the range of 80 mm to 700 mm, the recovery ratio was 100%. However, it was found that when the discharge position h is 800 mm or higher, the recovery ratio of the ABS decreased. This is because even some of the ABS resin pieces which were struck on lower edges with the first airflow F1 drop before the separation plate 5 without being blown up to the height of 800 mm. This phenomenon was confirmed by the observation using a high-speed camera.

It is therefore preferable that the discharge position h of the air supplied in the same orientation as the running direction of the conveyor 1 be 80 mm to 700 mm.

According to an implementation of the present invention, it is possible to increase the recovery amount of desired items of a specific constituent substance from a separation subject. The present invention is applicable to resource recycling of materials as a separation method of recycling items of a specific constituent substance from electronic waste and general waste.

REFERENCE SIGNS LIST

1 Conveyor
2 First target
3 Information obtaining unit
4 First blower
5 Separation plate
6 Second blower
7 Second target
100 Separation apparatus
101 Separation subject h Discharge position
F1 First airflow
F2 Second airflow
R1 First drop path
R2 Second drop path
R3 Third drop path

The invention claimed is:

1. A separation method of separating first targets and second targets from a separation subject in which the first targets and the second targets are mixed, said separation method comprising:

conveying the separation subject;

distinguishing the first targets in the separation subject;

obtaining positional information of the first targets distinguished in said distinguishing operation;

dropping the separation subject from an end of a conveyance path;

striking each of the first targets that is dropping with a first airflow, from under a drop path of the first target, so as to change the drop path of the first target upward, the first airflow being generated in a pulse mode; and blowing a second airflow on the first target, which is blown up to or above a predetermined height in said striking operation, so as to change the drop path of the first target such that the first target is blown a longer distance, the second airflow being generated at the predetermined height and in the same orientation as the first airflow shot out in said striking operation.

2. The separation method according to claim 1, wherein the second airflow in said blowing operation has a blowing rate of 3 msec to 30 msec.

3. The separation method according to claim 1, wherein the predetermined height in said blowing operation is 80 mm to 700 mm above a height at which the first airflow strikes the first targets in said striking operation.

4. A separation apparatus that separates first targets and second targets from a separation subject in which the first targets and the second targets are mixed, said separation apparatus comprising:

a conveyor which conveys the separation subject placed thereon and drops the separation subject at a predetermined position;

a distinguishing unit configured to distinguish the first targets in the separation subject;

a positional information obtaining unit configured to obtain positional information of the first targets distinguished by said distinguishing unit;

a first blower that generates, based on the positional information, a first airflow in a pulse mode which strikes each of the first targets that is dropping, said first blower being disposed under a drop path of the first target, so as to change the drop path of the first target; and a second blower that generates a second airflow which strikes the first target, which is blown up to or above a predetermined height by the first airflow generated by said first blower, so that the first target is blown a longer distance.

5. The separation method according to claim 2, wherein the predetermined height in said blowing operation is 80 mm to 700 mm above a height at which the first airflow strikes the first targets in said striking operation.

* * * * *